US009284171B2

(12) United States Patent
Ouvrard

(10) Patent No.: US 9,284,171 B2
(45) Date of Patent: Mar. 15, 2016

(54) GOOD-GRIP WINCH FOR HANDLING LOADS

(75) Inventor: Myrtil Ouvrard, Andard (FR)

(73) Assignee: FIXATOR, St Barthelemy d'Anjou (FR)

( * ) Notice: Subject to any disclaimer, the term of this patent is extended or adjusted under 35 U.S.C. 154(b) by 165 days.

(21) Appl. No.: 14/000,678

(22) PCT Filed: Jan. 3, 2012

(86) PCT No.: PCT/FR2012/050009

§ 371 (c)(1),
(2), (4) Date: Sep. 27, 2013

(87) PCT Pub. No.: WO2012/127137

PCT Pub. Date: Sep. 27, 2012

(65) Prior Publication Data

US 2014/0014887 A1 Jan. 16, 2014

(30) Foreign Application Priority Data

Mar. 23, 2011 (FR) ..... 11 52422

(51) Int. Cl.

| | |
|---|---|
| ***B66D 1/58*** | (2006.01) |
| ***B66D 3/18*** | (2006.01) |
| ***B66D 1/74*** | (2006.01) |

(52) U.S. Cl.

CPC ..... *B66D 1/58* (2013.01); *B66D 1/7415* (2013.01); *B66D 3/18* (2013.01)

(58) Field of Classification Search

CPC ..... B66D 1/50; B66D 1/505; B66D 1/525; B66D 1/56; B66D 1/58; B66D 3/24; B66D 3/26; B66D 2700/0183; B66D 2700/0191

See application file for complete search history.

(56) References Cited

U.S. PATENT DOCUMENTS

| | | | | | |
|---|---|---|---|---|---|
| 2,249,947 | A | * | 7/1941 | Doe | 254/274 |
| 2,340,067 | A | * | 1/1944 | Lessmann | 73/862.473 |
| 2,634,099 | A | * | 4/1953 | O'Leary | 173/9 |
| 3,015,473 | A | * | 1/1962 | Frellsen | 254/268 |
| 3,545,725 | A | * | 12/1970 | Chandler et al. | 254/331 |

(Continued)

FOREIGN PATENT DOCUMENTS

| | | | |
|---|---|---|---|
| DE | 38 32 000 | A1 | 4/1989 |
| GB | 2 136 582 | A | 9/1984 |
| JP | 11 218453 | A | 8/1999 |

OTHER PUBLICATIONS

International Search Report, dated Mar. 26, 2012, from corresponding PCT application.

*Primary Examiner* — Emmanuel M Marcelo
*Assistant Examiner* — Michael Gallion
(74) *Attorney, Agent, or Firm* — Sofer & Haroun, LLP

(57) ABSTRACT

A friction grip hoist (1) includes: at least one body (2); a pulley (3) mounted on the body, the pulley including a pin (4) and a wheel (5) having an outer peripheral groove (6) for receiving a cable; drive elements (7) for driving rotation of the wheel; and holder elements (15) for holding the cable inside the groove (6) of the wheel. The pin, referred to as a "dynamometer" pin, about which the wheel of the pulley is mounted to rotate is fitted with measurement elements (11) for measuring at least one magnitude representative of at least radial forces or loads exerted on the pin, and the hoist includes a monitor unit fitted with processor elements and with elements for issuing an alert signal and/or for controlling the elements (7) for driving rotation of the wheel of the pulley as a function of the at least one measured magnitude.

14 Claims, 2 Drawing Sheets

(56) References Cited

U.S. PATENT DOCUMENTS

| | | | | | |
|---|---|---|---|---|---|
| 3,698,690 | A * | 10/1972 | Beaver | 254/340 |
| 3,780,989 | A * | 12/1973 | Peterson | 254/273 |
| 3,836,122 | A * | 9/1974 | Pierce, Jr. | 254/273 |
| 4,005,852 | A * | 2/1977 | Schmitmeyer et al. | 254/266 |
| 4,354,608 | A * | 10/1982 | Wudtke | 212/308 |
| 4,384,493 | A * | 5/1983 | Grunbaum | 73/862.29 |
| 4,456,227 | A * | 6/1984 | Notenboom | 254/350 |
| 4,547,857 | A * | 10/1985 | Alexander | 700/275 |
| 4,706,940 | A * | 11/1987 | Harig | 254/333 |
| 5,271,608 | A * | 12/1993 | Kubono | 254/372 |
| 5,479,831 | A * | 1/1996 | Hirose | 73/862.44 |
| 5,607,142 | A * | 3/1997 | Nilsson | 254/298 |
| 5,626,081 | A * | 5/1997 | Kuryu | 104/197 |
| 5,633,904 | A * | 5/1997 | Gilligan et al. | 376/272 |
| 6,003,843 | A * | 12/1999 | Fujiwara et al. | 254/271 |
| 6,209,852 | B1 * | 4/2001 | George et al. | 254/372 |
| 6,237,502 | B1 * | 5/2001 | Van Damme | 104/173.1 |
| 6,354,158 | B1 * | 3/2002 | Eidem et al. | 73/862.56 |
| 6,442,439 | B1 * | 8/2002 | Robinett et al. | 700/55 |
| 7,080,825 | B1 * | 7/2006 | George et al. | 254/267 |
| 7,159,851 | B1 * | 1/2007 | Ross et al. | 254/275 |
| 7,303,049 | B1 * | 12/2007 | Greenlee | 182/37 |
| 7,309,059 | B2 * | 12/2007 | Marcil | 254/271 |
| 7,313,975 | B1 * | 1/2008 | Scorteanu | 73/862.454 |
| 7,331,254 | B2 * | 2/2008 | Petrak | 74/502.4 |
| 7,331,255 | B2 * | 2/2008 | Petrak | 74/502.4 |
| 7,819,042 | B2 * | 10/2010 | Petrak | 81/57.38 |
| 8,256,745 | B2 * | 9/2012 | Latoria | 254/346 |
| 8,766,812 | B2 * | 7/2014 | Pereira et al. | 340/668 |
| 2003/0227010 | A1 * | 12/2003 | Petrak | 254/294 |
| 2004/0148843 | A1 * | 8/2004 | Ikuta et al. | 43/21 |
| 2007/0145339 | A1 * | 6/2007 | Beaudoin et al. | 254/372 |
| 2009/0166459 | A1 * | 7/2009 | Niitsuma et al. | 242/287 |
| 2010/0294479 | A1 * | 11/2010 | Shee | 166/65.1 |
| 2011/0000865 | A1 * | 1/2011 | Jung et al. | 212/73 |
| 2011/0260126 | A1 * | 10/2011 | Willis | 254/283 |
| 2013/0037645 | A1 * | 2/2013 | Niitsuma et al. | 242/288 |
| 2014/0110517 | A1 * | 4/2014 | Niitsuma | 242/288 |
| 2014/0174727 | A1 * | 6/2014 | Huizer | 166/250.01 |

* cited by examiner

GOOD-GRIP WINCH FOR HANDLING LOADS

BACKGROUND OF THE INVENTION

1. Field of the Invention

The present invention relates to a friction grip hoist for handling loads.

2. Description of the Related Art

More particularly, the invention relates to a hoist comprising: at least one body; a sheave or pulley mounted on said body, said pulley comprising a pin and a wheel engaged on said pin, said wheel, referred to as a "grooved" wheel, being provided with an outer peripheral groove for receiving a cable; drive means for driving rotation of said wheel; and holder means suitable for exerting a thrust force towards the bottom of the groove of the wheel in order to hold the cable inside the groove of the wheel by pressing thereagainst.

One such hoist is known from U.S. Pat. No. 4,005,852.

Friction grip hoists should not be confused with drum hoists or jaw hoists. Friction grip hoists present the characteristic of being suitable for use with a cable of great length on the basis of the cable being held by gripping inside a single groove of the pulley, the width of the groove corresponding substantially to the diameter of the cable that is to be received in the groove, such that the cable presents only one turn wound around said pulley.

Such friction grip hoists are used in particular for accessing the outsides of buildings, for accessing work zones in elevator shafts, in wells, in silos, ( . . . ). Compared with other hoists they present the following advantages:

no limit on height; and the hoist can accompany the load.

Until now, in order to avoid overloading the hoist and in order to guarantee that the hoist stops operating on exceeding the theoretical capacity of the hoist, a friction grip hoist presents at least one force sensor in its zone where it is fastened to the equipment fitted with the hoist. This force sensor may for example be in the form of a spring arranged in the zone where the hoist is fastened to the equipment fitted with the hoist.

There are numerous drawbacks in such a solution:

- the measurement means for avoiding an overload are dedicated to the fitted hoist;
- the measurement means for avoiding an overload require predetermined fastening of the hoist to the equipment that is fitted with the hoist; and
- the measurement means for avoiding an overload are generally very sensitive, and as a result they are difficult to adjust and lack accuracy.

SUMMARY OF THE INVENTION

An object of the present invention is thus to propose a friction grip hoist of the above-mentioned type in which the design of the means for detecting an overload makes it possible to avoid having any particular kind of fastening between the hoist and the equipment fitted with the hoist.

Another object of the present invention is to provide a friction grip hoist in which the design of the overload detection means make it possible to obtain measurements that are reliable and reproducible.

Another object of the present invention is to propose a friction grip hoist of a design that makes it possible to limit the wear of said overload detection means over time.

To this end, the invention provides a friction grip hoist for handling loads, said hoist comprising: at least one body; a pulley mounted on said body, said pulley comprising a pin and a wheel arranged on said pin, said wheel, referred to as a "grooved" wheel, being provided with an outer peripheral groove for receiving a cable; drive means for driving rotation of said wheel; and holder means suitable for exerting a thrust force towards the bottom of the groove of the wheel in order to hold the cable inside the groove of the wheel by pressing thereagainst; the hoist being characterized in that the pin, known as a "dynamometer" pin, about which the wheel of the pulley is mounted to rotate is fitted with measurement means for measuring at least one magnitude representative of the at least radial forces or loads exerted on said pin, and in that the hoist includes a monitor unit suitable for communicating with said measurement means, said monitor unit being fitted with processor means for processing said at least one magnitude measured by said measurement means and with means for issuing an alert signal and/or for controlling the means for driving rotation of the wheel of the pulley as a function of said at least one measured magnitude.

Incorporating the means for measuring at least one magnitude representative of the at least radial forces or loads exerted on said pin inside the pin, which is itself suitable for deforming, in particular sagging, under the action of the weight of the load, makes it possible to use measurement means that are reliable, compact, and independent of the way in which the hoist is fastened to the equipment fitted with the hoist.

Preferably, the means for driving rotation of the wheel of the pulley comprise at least one motor, preferably a gearmotor, a driving member suitable for being driven in movement by said motor, and a driven member arranged on the wheel of the pulley and engaging with said driving member, and the driving member of the means for driving rotation of the wheel of the pulley and the holder means for holding the cable inside the groove of the wheel of the pulley are arranged in diametrically opposite positions around said wheel of the pulley.

This arrangement serves to reduce the stress on the pin. The radial forces acting on the wheel and resulting from meshing between the driving member and the driven member and from the holder means pressing against the wheel tend to cancel as a result of the diametrically opposite positions of the driving member and of the holder means, such that the pin is subjected little or not at all to the action of said forces. By means of this arrangement, it is possible to incorporate the means for measuring the radial forces exerted on the pin inside the pin, while obtaining measurement results that are linked essentially with the action of the load on said pin. This leads to less fatigue of the pin.

Preferably, the driving member of the means for driving rotation of the wheel of the pulley comprise at least one rotary gearwheel, and the driven member of the means for driving rotation of the wheel of the pulley comprises a circumferential set of teeth preferably arranged at the top of one of the flanks of the groove of the wheel of the pulley.

The holder means for holding the cable inside the groove of the wheel of the pulley comprise at least one rocker fitted with two rollers inserted at least in part inside the groove of the wheel and mounted to rotate about respective axes parallel to the axis of rotation of the wheel of the pulley, said rocker being fitted with a pivot lever loaded by a spring urging said rollers to press against the bottom of the groove.

The rocker with its two rollers is thus arranged on a diameter of the wheel of the pulley passing via the pin of the wheel and the driving member of the means for driving rotation of the wheel.

In order to facilitate deformation of the pin, in particular under the action of the load, the pin about which the pulley wheel is mounted to rotate is a pin mounted on the body, which pin is fastened at one of its ends while being free at its other end. The pin can thus deflect under the action of the load.

Preferably, the monitor unit has means for inputting an "overload" threshold value, said processor means of processing said at least one measured magnitude comprise means for comparing said at least one magnitude measured by said measurement means with said overload threshold value, and said means for issuing an alert signal and/or for controlling the means for driving rotation of the wheel are configured to issue an alert signal and/or to stop the operation of the means for driving rotation of the wheel in the load-raising direction when the value of said at least one measured magnitude is greater than the predetermined overload threshold value.

Other threshold values may be defined for performing other actions: stopping when depositing the load on the ground (loss of load on the pin), stopping in the event of a jam inside the hoist (sudden change in the force on the pin), . . . .

Generally, the pin about which the pulley wheel is mounted to rotate is provided with an axial bore receiving the means for measuring at least one magnitude representative of the at least radial forces or loads exerted on the pin.

This leads to an assembly that is compact.

BRIEF DESCRIPTION OF THE DRAWING FIGURES

The invention can be well understood on reading the following description of embodiments given with reference to the accompanying drawings, in which.

DETAILED DESCRIPTION OF THE INVENTION

Figure 1:
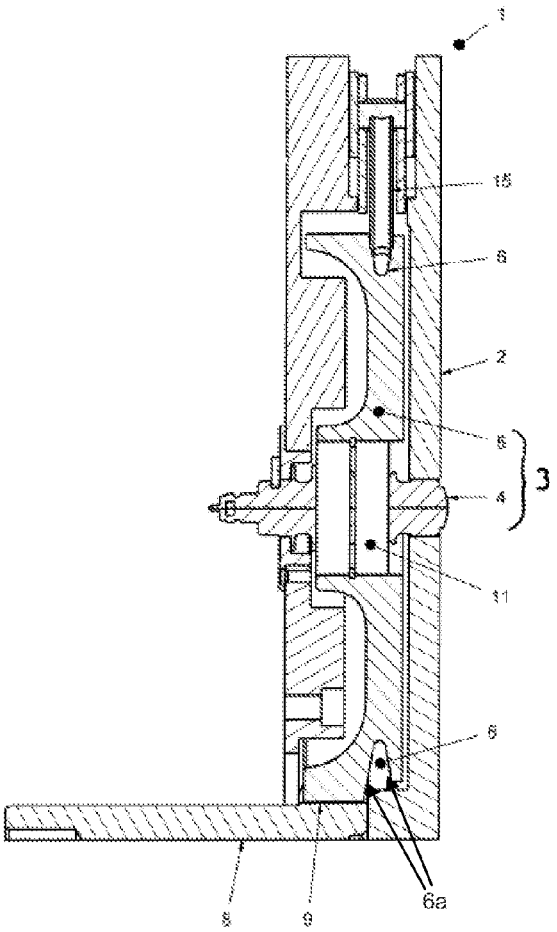
FIG. 1 is a fragmentary section view of a hoist in accordance with the invention, the monitor unit and the motor being omitted.

As mentioned above, the hoist 1 of the invention is a friction grip hoist for handling loads. These loads may be varied and diverse, and include in particular a platform for hoisting people.

The hoist 1 comprises at least one body 2 and a pulley 3 mounted on said body 2. Said pulley 3 has a pin 4 and a wheel 5 engaged on the pin 4. The wheel 5 has a circular outer peripheral groove 6 for receiving a cable 20. The groove 6 has a bottom and two flanks 6*a*. The hoist 1 also has drive means 7 for driving rotation of said wheel 5 about the pin 4 and holder means 15 for exerting a thrust force towards the bottom of the groove 6 of the wheel 5 in order to hold the cable in the groove 6 of the wheel 5 by applying thrust.

In general, the cable 20 is fitted at one of its ends with means for attaching to the load. It may also be fastened at one of its ends at a stationary elevation and it may be coupled via the body 2 of the hoist 1 to an element for driving up and down movements, e.g. of a platform.

In a manner characteristic of the invention, the pin 4, referred to as a "dynamometer" pin, about which the wheel 5 of the pulley 3 is mounted to rotate, is fitted with measurement means 11 for measuring at least one magnitude representative of the at least radial forces or loads exerted on said pin 4, and the hoist 1 includes a monitor unit 12 suitable for communicating with said measurement means 11, said monitor unit being fitted with processor means 13 for processing said at least one magnitude measured by said measurement means 11 and means 14 for issuing an alert signal and/or for controlling the drive means 7 for driving rotation of the wheel 5 of the pulley 3 as a function of said at least one measured magnitude.

As mentioned above, the means 7 for driving rotation of the wheel 5 of the pulley 3 comprise at least one motor 10, a driving member 8 being suitable for being driven in rotation by said motor, and a driven member 9 arranged on the wheel 5 of the pulley 3 and engaging with said driving member 8. The driving member 8 of the means 7 for driving rotation of the wheel 5 of the pulley and the holder means 15 for pressing against the cable 20 to hold it inside the groove 6 of the wheel 5 of the pulley 3 are arranged in diametrically opposite positions around said wheel 5 of the pulley 3.

In the examples shown, the driving member 8 is a centrally hollow rotary gearwheel suitable for being engaged on the drive shaft of the gearmotor 10 and it is driven in rotation thereby.

The axis of rotation of the gearwheel is parallel to the axis of rotation of the pin 4 of the wheel. This gearwheel meshes with a circumferential set of teeth arranged on the top of one of the flanks of the groove 6 of the wheel 5 of the pulley 3, thereby forming the driven member 9 of the means 7 for driving rotation of the wheel 5 of the pulley 3.

The holder means 15 for holding the cable 20 inside the groove 6 of the wheel 5 of the pulley 3 comprise at least one rocker 16 having two rollers 17 inserted at least in part into the groove 6 of the wheel 5 and mounted to rotate about respective axes parallel to the axis of rotation of the wheel 5 of the pulley 3. Said rocker 16 is fitted with a pivot lever 18 that is biased by a spring 19 that urges said rollers 17 to press against the bottom of the groove 6.

The zone of meshing between the gearwheel and the set of teeth is thus arranged around the wheel 5 of the pulley 3 in a position that is diametrically opposite the position of the assembly constituted by the rocker 16 and the rollers 17. The spring 19 of the lever 18 urges the lever 18 in the direction to press the wheel 17 against the bottom of the groove and it extends between the lever and the body 2. The spring 19 is made up of a plurality of spring washers, also known as "Belleville" washers.

The body 2 in this example is made up of two plates that are arranged on either side of the wheel 5 of the pulley 3, and in particular of the faces of the wheel 5, each plate being centrally hollowed out in order to enable said plates to be engaged on the pin 4 of the wheel 5 of the pulley 3.

In the examples shown, the pin 4 about which the wheel 5 of the pulley 3 is mounted to rotate is a pin 4 that is mounted on the body 2, being fastened at one of its ends and free at its other end in order to facilitate deformation of said pin 4.

One of the ends of the pin 4 is thus inserted into a hole in the plate and is held inside said hole by a key or cotterpin so as to be held stationary both in translation and in rotation relative to said body, while the other end of the pin 4 is merely inserted in a hole in the plate and is mounted free to move in rotation and in translation inside said hole so as to enable the pin to deform, in particular to deflect under the load when it is subjected to a radial force via the wheel of the pulley 3.

The pin 4 is also fitted externally with ball bearings interposed between the pin and the hub of the wheel so as to enable the wheel 5 to rotate freely on said pin 4.

The pin 4 about which the wheel 5 of the pulley is mounted to rotate is provided with an axial bore that receives the means 11 for measuring at least one magnitude representative of the at least radial forces or loads exerted on the pin.

The means 11 for measuring at least one magnitude representative of the at least radial forces or loads exerted on the pin comprise at least one strain gauge.

These measurement means 11 also comprise means for acquiring the voltage from the terminals of the gauge, said voltage being proportional to the force acting on the pin. By way of example, these measurement means may comprise four resistors including one strain gauge arranged in a Wheatstone bridge circuit. The bridge is powered electrically. When a force is applied, the electrical resistance of a strain gauge is modified by the gauge deforming. This resistance is measured by balancing the bridge and thus makes it possible to determine the force to which said pin is being subjected.

Thus, the dynamometer pin incorporating such measurement means and sold under the reference LE-LU 210 by the supplier Magtrol gives good results.

The value of said at least one magnitude representative of the at least radial forces or loads acting on said pin and as measured by said measurement means is transmitted to the monitor unit 12.

Figure 2:
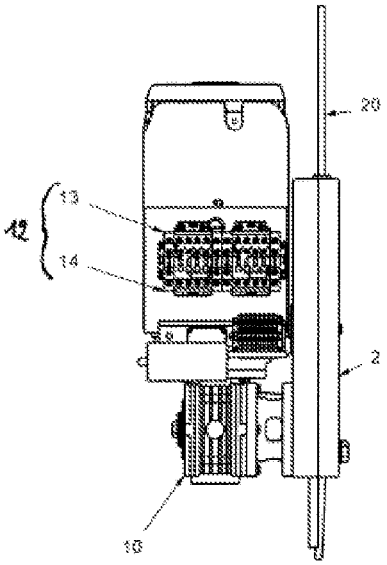
FIG. 2 is a side view of a hoist in accordance with the invention.
Figure 4:
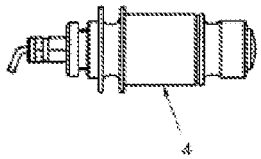
FIG. 4 is a perspective view of the pin about which the pulley wheel is mounted to rotate.
Figure 3:
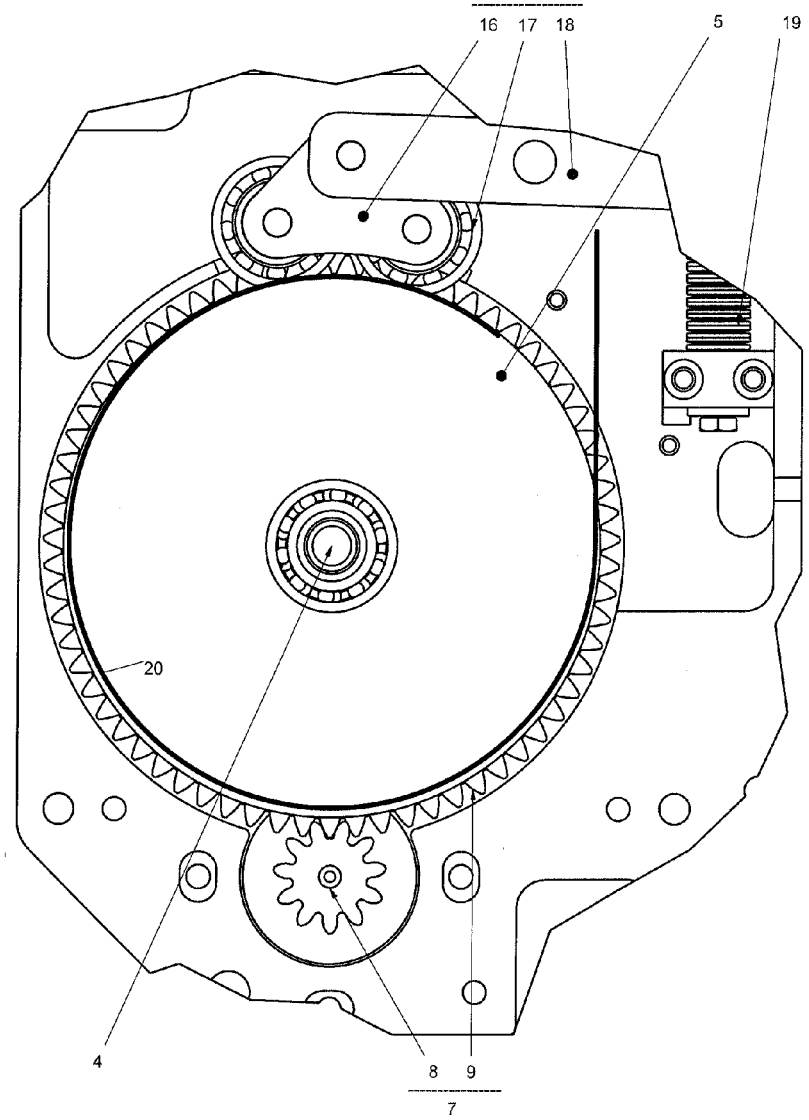
FIG. 3 is a face view of a hoist in accordance.

For this purpose, the pin 4 is fitted at its end with a connector for connection to the monitor unit 12. The monitor unit 12 is housed in a box that also contains the motor 10 of the means 7 for driving rotation of the wheel, this box being adjacent to the plate of the above-described body 2, as shown in FIG. 2.

The monitor unit 12 has means 13 for processing said at least one magnitude measured by said measurement means 11, and means 14 for issuing an alert signal and/or for controlling the means 7 for driving rotation of the wheel of the pulley 3 as a function of said at least one measured magnitude.

In particular, the monitor unit 12 has means for inputting a threshold value referred to as an overload value. By way of example, these input means are formed by a display forming part of said box. The operator uses said display to select the desired overload threshold value. The means 13 for processing said at least one measured magnitude, such as the microprocessor, comprise means for comparing said at least one magnitude measured by the measurement means 11 with the overload value. The means 14 for issuing an alert signal and/or for controlling the means 7 for driving rotation of the wheel 5 are configured to issue an alert signal and/or to stop the operation of the means 7 for driving rotation of the wheel 5 in the load-raising direction when the value of said at least one measured magnitude is greater than the predetermined overload threshold value. These means 14 for issuing an alert signal may be constituted by causing the display to flash or by an alarm device that issues an audible or a visible signal.

The monitor unit 12 preferably has means for inputting a threshold value referred to as a "load-deposition value". Said processor means 13 for processing at least one measured magnitude in the monitor unit 12 comprise means for comparing said at least one magnitude measured by said measurement means 11 with said load-deposition value. Said means 14 for issuing an alert signal and/or for controlling the means 7 for driving rotation of the wheel in the monitor unit 12 are configured to issue an alert signal and/or to stop the operation of the means 7 for driving rotation of the wheel in a load-lowering direction when the value of said at least one measured magnitude is less than the predetermined load-deposition threshold value.

The display may also enable an operator to input a load-deposition threshold value and it may flash in the event of an alert.

The operation of such a friction grip hoist is similar to that of a conventional friction grip hoist concerning the raising and lowering of the load with the help of the cable 20.

The invention claimed is:

1. A friction grip hoist (1) for handling loads, said hoist comprising:

at least one body (2);

a pulley (3) mounted on said body (2), said pulley (3) comprising a pin (4) and a wheel (5) arranged on said pin (4), said wheel (5), being a grooved wheel provided with an outer peripheral groove (6) for receiving a cable (20);

drive means (7) for driving rotation of said wheel (5); and holder means (15) suitable for exerting a thrust force towards a bottom of the groove (6) of the wheel (5) in order to hold the cable (20) inside the groove (6) of the wheel (5) by pressing there against; wherein the pin (4), being a dynamometer pin, about which the wheel (5) of the pulley (3) is mounted to rotate is fitted with measurement means (11) for measuring at least one magnitude representative of the at least radial forces or loads exerted on said pin (4), in that the pin (4) about which the pulley wheel (5) is mounted to rotate is provided with an axial bore receiving the means (11) for measuring at least one magnitude representative of the at least radial forces or loads exerted on the pin, the means (7) for driving rotation of the wheel (5) of the pulley (3) comprise at least one motor (10), a driving member (8) suitable for being driven in movement by said motor (10), the driving member (8) of the means (7) for driving rotation of the wheel (5) of the pulley (3) comprising at least one rotary gearwheel, and a driven member (9) arranged on the wheel (5) of the pulley (3) and engaging with said driving member (8), the driven member (9) of the means for driving rotation of the wheel of the pulley comprising a circumferential set of teeth arranged at a top of one of the flanks of the groove (6) of the wheel (5) of the pulley (3), and the hoist (1) includes a monitor unit (12) suitable for communicating with said measurement means (11), said monitor unit (12) being fitted with processor means (13) for processing said at least one magnitude measured by said measurement means (11) and with means (14) for issuing an alert signal and/or for controlling the means (7) for driving rotation of the wheel (5) of the pulley (3) as a function of said at least one measured magnitude.

2. The hoist (1) according to claim 1, wherein the driving member (8) and the holder means (15) are arranged in diametrically opposite positions around said wheel (5) of the pulley (3).

3. The hoist (1) according to claim 1, wherein the holder means (15) comprise at least one rocker (16) fitted with two rollers (17) inserted at least in part inside the groove (6) of the wheel (5) and mounted to rotate about respective axes parallel to an axis of rotation of the wheel (5) of the pulley (3), said rocker (16) being fitted with a pivot lever (18) loaded by a spring (19) urging said rollers (17) to press against the bottom of the groove (6).

4. The hoist (1) according to claim 1, wherein the pin (4) about which the wheel (5) of the pulley (3) is mounted to rotate is a pin (4) mounted on the body (2), being fastened at one end and free an other end in order to facilitate deformation of said pin (4).

5. The hoist (1) according to claim 1, wherein the monitor unit (12) has means for inputting an overload threshold value, in that said processor means (13) of processing said at least one measured magnitude comprise means for comparing said at least one magnitude measured by said measurement means (11) with said overload threshold value, and in that said means (14) for issuing an alert signal and/or for controlling the means (7) for driving rotation of the wheel (5) are configured to issue an alert signal and/or to stop the operation of the means (7) for driving rotation of the wheel in a load-raising direction when a value of said at least one measured magnitude is greater than the predetermined overload threshold value.

6. The hoist (1) according to claim 1, wherein the monitor unit (12) has means for inputting a load-deposition threshold value, in that said processor means (13) comprise means for comparing said at least one magnitude measured by said measurement means (11) with said load-deposition threshold value, and in that said means (14) for issuing an alert signal and/or for controlling the means (7) for driving rotation of the wheel (5) are configured to issue an alert signal and/or to stop the operation of the means (7) for driving rotation of the wheel in the load-lowering direction when a value of said at least one measured magnitude is less than a predetermined load-deposition threshold value.

7. The hoist (1) according to claim 1, wherein the means for measuring at least one magnitude representative of the at least radial forces or loads exerted on the pin comprise at least one strain gauge.

8. A friction grip hoist for handling loads, said hoist comprising:

at least one body;

a pulley mounted on said body, said pulley comprising a dynamometer pin and a wheel arranged on said pin, said wheel being a grooved wheel provided with an outer peripheral groove for receiving a cable;

a drive driving rotation of said wheel, the drive comprising at least one motor, a driving member driven by the motor, the driving member comprising at least one rotary gearwheel, and a driven member arranged on the wheel and engaging with said driving member, the driven member comprising a circumferential set of teeth arranged at a top of one of the flanks of the groove of the wheel of the pulley; and a holder suitable for exerting a thrust force towards a bottom of the groove of the wheel in order to hold the cable inside the groove by pressing;

a measurement device fitted to the dynamometer pin, about which the wheel of the pulley is mounted to rotate, the measurement device being configured for measuring at least one magnitude representative of the at least radial forces or loads exerted on said dynamometer pin, the dynamometer pin being provided with an axial bore receiving the measurement device; and a monitor unit suitable for communicating with said measurement device, said monitor unit being fitted with a processor configured for processing said at least one magnitude measured by said measurement device and to issue an alert signal and/or for controlling the drive as a function of said at least one measured magnitude.

9. The hoist according to claim 8, wherein the driving member and the holder are arranged in diametrically opposite positions around said wheel.

10. The hoist according to claim 8, wherein the holder comprises at least one rocker fitted with two rollers inserted at least in part inside the groove of the wheel and mounted to rotate about respective axes parallel to an axis of rotation of the wheel of the pulley, said rocker being fitted with a pivot lever loaded by a spring urging said rollers to press against the bottom of the groove.

11. The hoist according to claim 8, wherein the pin about which the wheel of the pulley is mounted to rotate is a pin mounted on the body, being fastened at one end and free an other end in order to facilitate deformation of said pin.

12. The hoist according to claim 8, wherein the monitor unit is configured to input an overload threshold value, in that said processor compares said at least one magnitude measured by said measurement device with said overload threshold value, and processor is configured to issue an alert signal and/or to stop operation of the drive in a load-raising direction when a value of said at least one measured magnitude is greater than the predetermined overload threshold value.

13. The hoist according to claim 8, wherein the monitor unit is configured to input a load-deposition threshold value, said processor processing said at least one measured magnitude comprises a comparator comparing said at least one magnitude measured by said measurement device with said load-deposition threshold value, and the processor is configured to issue an alert signal and/or to stop the operation of the drive in the load-lowering direction when a value of said at least one measured magnitude is less than a predetermined load-deposition threshold value.

14. The hoist according to claim 8, wherein the measuring device comprises at least one strain gauge.

* * * * *